United States Patent [19]

Ladyjensky

[11] Patent Number: 5,067,051

[45] Date of Patent: Nov. 19, 1991

[54] CHEMILUMINESCENT LIGHTING ELEMENT

[75] Inventor: Jacques Ladyjensky, Brussels, Belgium

[73] Assignee: American Cyanamid Company, Stamford, Conn.

[21] Appl. No.: 542,138

[22] Filed: Jun. 22, 1990

[30] Foreign Application Priority Data

Jul. 7, 1989 [BE] Belgium ..... 08900744

[51] Int. Cl.[5] ..... F21K 2/00

[52] U.S. Cl. ..... 362/34; 206/219

[58] Field of Search ..... 362/34, 84; 206/219, 206/221; 313/483; 252/700

[56] References Cited

U.S. PATENT DOCUMENTS

| | | | |
|---|---|---|---|
| 3,290,017 | 12/1966 | Davies et al. | 206/221 X |
| 3,314,563 | 4/1967 | Mounier | 206/221 |
| 3,464,414 | 9/1969 | Sponnoble | 206/221 |
| 3,539,794 | 11/1970 | Rauhut et al. | 362/34 |
| 4,015,111 | 3/1977 | Spector | 362/34 |
| 4,061,910 | 12/1977 | Rosenfeld | 362/34 |
| 4,064,428 | 12/1977 | Van Zandt | 362/34 |
| 4,924,358 | 5/1990 | Von Heck | 362/34 X |

*Primary Examiner*—Ira S. Lazarus
*Assistant Examiner*—D. M. Cox
*Attorney, Agent, or Firm*—Frank M. Van Riet

[57] ABSTRACT

The invention relates to a chemiluminescent article, which comprises a tube made of a flexible, light-transmitting and chemically stable material, closed at both of its ends, and which comprises at least two compartments which are filled with liquids which produce chemiluminescent light when mixed. The tube contains, between the ends, an internal diaphragm or disk, which separates the tube into said compartments. The diaphragm or disk has approximately a flat circular shape, with a cross-section which is approximately rectangular in profile, and is placed transversely with respect to the axis of the tube. The edge is in continuous contact with the interior of the wall of the tube. The elasticity, the external diameters and the internal diameters of the tube and, the diameter and the thickness of the diaphragm are selected in such a manner that the diaphragm can be tilted by simple manual pressure against the external walls of the tube, which pressure imparts a tilting torque to said diaphragm or disk and allows mixing of the contents of the compartments.

11 Claims, 2 Drawing Sheets

CHEMILUMINESCENT LIGHTING ELEMENT

SUMMARY OF THE INVÈNTION

The present invention relates to a lighting unit which comprises of a tube made of a light transmitting flexible material. This article, in its passive state, comprises at least two compartments, each of which contains a chemical liquid which, in the active stage of the article, mix to yield a chemical reaction which generates light.

BACKGROUND OF THE INVENTION

Lighting units are already known which are based on the chemiluminescent emission generated by the mixing of two liquids. One system, which is used commercially on a wide scale, is described, for example, in U.S. Pat. No. 3,576,987; it consists of a first liquid solution in a hollow tube made of a light transmitting and slightly flexible plastic, and a second liquid solution contained in a glass vial or glass capillary which floats in the first solution. When the user bends the tube, the internal glass unit breaks and releases the second solution which mixes with a first solution. This system is not without drawbacks. The presence of a sealed glass vial, or a sealed glass capillary, has an unfavorable effect on the solutions used and over long periods of time it causes changes in the solutions. The presence of glass debris, sometimes with sharp points, is not always welcomed by the users who may fear, whether correctly or incorrectly, that the external envelope could break accidentally. Finally, in the fairly frequent case of a glass container in the form of an elongated capillary, there exists the danger of premature breaking during handling operations.

In addition, systems have been proposed—none of which is commercially used yet—which are based on the presence of two compartments which are temporarily separate and exist in the same closed container or recipient. The separation is achieved either by a temporary pinching or folding of the container, or by the existence of a medial separation wall which can be eliminated by breaking, tearing or unclipping. Several proposals of this type have been described in U.S. Pat. Nos. 3,749,620, 3,539,794, 3,893,938, 3,808,414, 4,061,910 and 3,149,943 as well as in French Patent No. 87 11 296. In the above-mentioned U.S. Pat. No. 3,749,620, a long list of earlier patents is given, patents which have disclosed the existance of containers with two components which are to be mixed. One should observe in this regard, to be complete, that in most cases these are not chemiluminescent liquids, and in many cases, the substances are not necessarily liquids.

Consequently, there is always a need for the economic production of articles which generate chemiluminescent light, and which, by nature, are intended for a single use.

DESCRIPTION OF THE INVENTION

Including Preferred Embodiments

The article according to the present invention, comprises a flexible and light transmitting tube made of a plastic material, which is closed at both ends and which contains, between these ends, an internal diaphragm or disk, which separates the content of the tube into at least two compartments, which diaphragm or disk comprises a flat circular configuration.

This disk, in a profile cross-section, has an approximately rectangular section, that is, it has a reasonably peripheral sharp edge. Said edge or border of the disk is placed perpendicular to the longitudinal axis of the tube, and is in close contact with the internal side of the wall of the tube, thus defining compartments, which are each filled with a liquid solution for the purpose of creating a chemiluminescent emission, when mixed.

The disk is rigid or, in any case, significantly more rigid than the material which forms the tube.

To cause the mixing, it is enough to perform a simple movement, from the exterior of the tube and without damaging it, to tilt the disk so that its plane becomes approximately parallel to the longitudinal axis of the tube. This movement can be performed, for example, by using one's fingers to impart a tilting torque to the separation disk.

For this tilting motion to be possible, the disk should not be too thick. It has been found that a thickness from about 1 to about 4 mm is appropriate for a tube with an interior diameter between about 8 and about 18 mm, i.e. the thickness of the disk should not be greater than about one half the interior diameter of the tube. With regard to the material which consititutes the disk and the tube, it is preferably selected among polyolefins, that is plastic materials which have good resistance against chemiluminescent solutions. Polyethylene is particularly indicated because its waxy surface promotes the sealing of the contact between the disk and the interior of the wall of the tube. The disk itself can be made of a rigid material, for example, a high-density polyethylene or a polypropylene.

According to a preferred embodiment, the diameter of the disk is selected in such a manner that it is slightly greater than the internal diameter of the tube and so that its border, or edge, applies pressure against the wall of the tube, and said wall applies a pressure because of its own elasticity, thus insuring a more secure sealing connection.

It has also been observed that it is advantageous to grease the border or edge of the disk before the placement of the latter. This greasing facilitates the positioning, and, moreover, it improves the sealing properties. The grease used for this purpose must naturally be compatible with the chemical nature of the liquids. A silicon grease with appropriate viscosity can be used.

According to another embodiment, to improve the sealing properties even further—particularly when one wishes the article to be capable of tolerating a long storage time before its use—one provides, around the tube, an external ring or sheath, for example, made of a rigid plastic material or of metal. This ring or sheath is placed concentrically with respect to the tube and on the exterior of the latter, at the level of the internal disk i.e. surrounding the disk. It consists of a cylinder with a length of about 2 to about 15 mm and a wall thickness of about 0.5 to 5 mm. The internal diameter of the ring or sheath is slightly less than the external diameter of the tube, as recorded perpendicularly to the disk.

The ring or sheath is preferably made of a rigid material. It can be prepared, for example, by the injection molding of a polycarbonate material.

When a ring or sheath is used, the disk can have either the same diameter as the internal diameter of the tube or it can be slightly smaller than the internal diameter of the tube.

According to another variant, the diameter of the disk is large, but in this case again, the internal diameter of the ring or sheath should be very slightly smaller than the external diameter of the swollen tube at the position of the disk.

The slight difference in diameters which has just been described is enough to cause, according to the principle or a band reinforcement, a large centripetal or afferent compression which insures the sealing properties. This compression is absorbed by the elasticity of the material of the tube wall and somewhat by the elasticity of the disk material itself, the latter being subjected to a centripetal, or afferent force in its own plane.

To activate the article, it suffices to slide the ring or sheath in the direction of the axis of the tube, until a sufficiently large zone is cleared on both sides of the disk to permit the tilting motion which is executed manually, as described above.

If the disk diameter is slightly less than the tube diameter, the creation of a communications link between the two compartments will occur, however, automatically when the tightening ring or sheath is shifted sufficiently along the axis of the tube.

The presence of the ring or sheath also contributes to the prevention of any accidental tilting of the disk before its final use, particularly during handling operations in transport and storage.

The sliding of the ring or sheath, at the time of use, as during the assembly, is facilitated by the waxy property of the polyethylene which is the preferred material for the tube. The sliding of the ring, due to the pressure of exerts on the tube, can also cause the disk to tilt in order to activate the device.

An interesting advantage of the method of preparation of the tube is the fact that it permits the use of a tube whose wall consists of two or more layers of plastic material or other materials, the combination of which constitutes a barrier material which is effective against permeation of gas. This multilayer embodiment can be prepared very economically, for example, by using the so-called coextrusion process, which is applied only to extruded products, ideally, tubes.

The impermeability to gases, which is unsatisfactory with tubes made of simple polyethylene, is, in effect, a very significant advantage in containers for chemiluminescent liquids, in that the latter are changed by the diffusion of water vapor or moisture through the walls. Also, the decomposition products contain carboxylic anhydride which can escape through the polyethylene wall, thus further promoting the decomposition reaction. Consequently, the containers for chemiluminescent liquids used commercially—which are made of polyethylene because of the other properties of this material—are, in general, packaged in a barrier material; for example, a bag made from a barrier foil which is laminated into a sheet. The coextrusion process permits the production of a tube with a coextruded barrier wall, or possibly a tube having a wall which is coated continuously on its external side with an economic, protective additive, and in that manner one can omit the exterior packaging.

The chemiluminescent article which is the object of the present invention does not necessarily require that the above described tube have the same cross-section along its entire length. It is only in proximity to the disk that the cross-section must be cylindrical. At other places and, possibly, on both sides of the region where the disk is located, the contour of the tube can form any shape, so that its capacity is locally increased. The aesthetic appearance of the entire assembly of the article can thus be changed significantly. The well-known process of extrusion blowing permits the preparation of such hollow bodies made of polyolefins in a continuous, economical process.

The invention will be understood better with reference to FIGS. 1 to 4.

FIG. 1 represents a cross-section of a tube consisting of wall 1 and disk 2 which separates said tube into two compartments which contain liquids 3 and 4 which, when mixed, produce light by chemiluminescence. Ends 5 of the tube are closed, or sealed.

Figure 1:
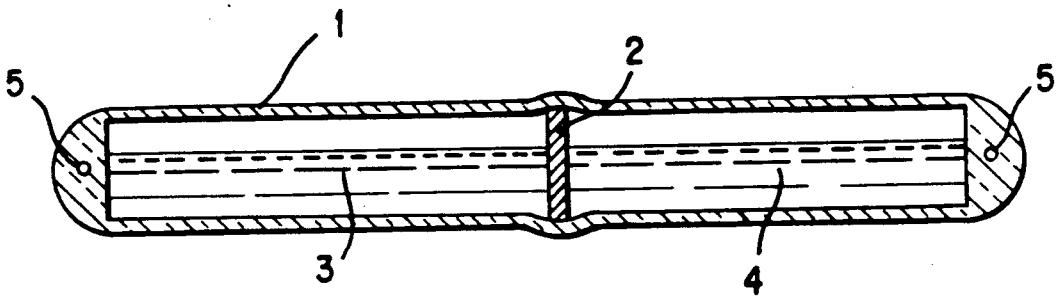
Figure 2:
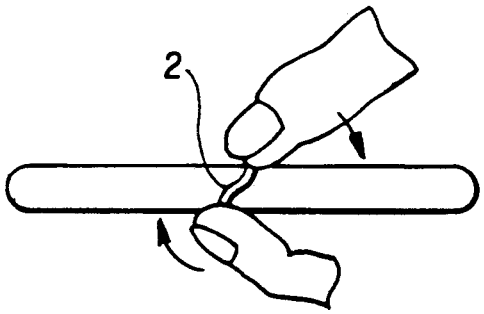
FIG. 2 is a diagrammatic representation of the tilting of the disk by the fingers of the user to enable the contents of the compartments to mix and thereby cause chemiluminescence.
Figure 3:
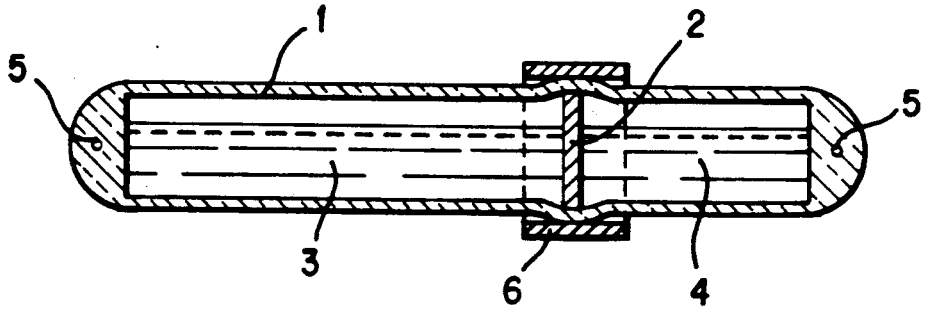
FIG. 3 represents the article of FIG. 1 with, in addition, an external reinforcement ring or sheath 6.
Figure 4:
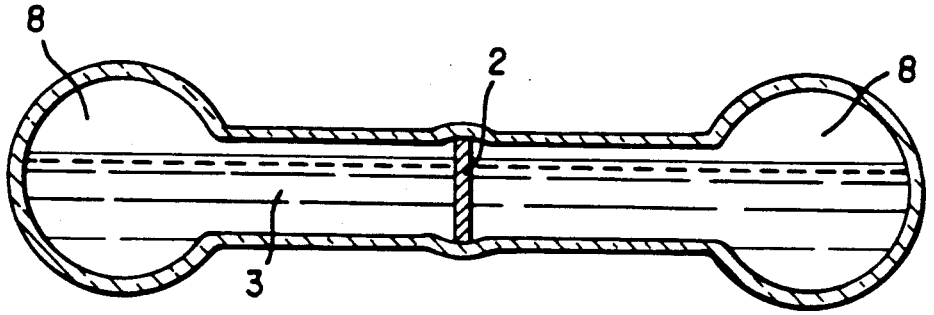
FIG. 4 illustrates the case where bulging sections 8 have been provided at the ends of the tube to create a unique configuration.

The invention also relates to a simple method for the manufacturing of articles according to the invention.

The method according to the invention consists in positioning vertically a hollow tube made of flexible material, open at both ends. Through the lower end of the tube, one introduces a solid cylinder or rod having an appropriate diameter up to the place where the tube is to be separated into the two compartments. The end of the solid cylinder or rod consists of a surface which is perpendicular to the axis of the rod.

Through the upper end of the tube, one drops the disk made of a rigid material and with a diameter slightly larger than the internal diameter of the tube. To achieve this, the tube's shape is changed, for example, manually, to form an elliptical cross-section which allows the disk to fall to the cylinder or rod which forms a stop. The disk is then positioned vertically with respect to this stop, in that a second rod similar to the first one is introduced through the upper open end whereby pressure against the second rod and, consequently against the facing rod, causes the disk to be positioned perpendicularly to the axis of the tube by overcoming the elastic resistance of the walls.

In the case where the diameter of the disk is less than the internal diameter of the tube, when one uses a sleeve or sheath with an internal diameter which is smaller than the external diameter of the tube, changing the shape of the tube is clearly not necessary for the disk to fall and no second rod is usually necessary. The sleeve or sheath is merely placed over the tube and positioned manually so as to create a sealing force on the disk.

The entire set of operations to place the disk can easily be mechanized.

In separate steps, after having removed the rods, one charges the appropriate liquid into the first compartment of the tube and closes off the end, and then one charges, with a second liquid, and closes similarly, the second compartment.

The closing of the end of the polyethylene tube can be achieved by various techniques which are well known to the expert, for example:

the insertion of the end of the tube into a heated squeeze roller, which is approximately hemispherical, followed by removal for cooling after the melting;

the placement of a polyethylene stopper which is soldered to the tube by heat or ultrasound;

the placement of a polyethylene stopper in the end of the tube, which is then reinforced by placing a tightening ring, preferably made of metal or a very rigid plastic, around the stopper, etc.

An example of an embodiment of the invention is given below.

One takes a tube extruded from a low density transparent or translucent i.e. light transmitting, and flexible polyethylene, with an external diameter of 12.8 mm and a wall thickness of 0.6 mm, cuts it to the desired length of 10 cm and places it vertically.

Through the lower end, one introduces a cylindrical rod made of aluminum, with a diameter of 11.6 mm, up to a distance of 40 mm from said end.

Through the upper end, one drops a disk made of a high density polyethylene, with a diameter of 12.8 mm and a thickness of 1.5 mm, with the fall of the disk being achieved by manually squeezing the tube along the path of the fall. The disk is then in a position against the aluminum rod and is wedged perpendicularly to the axis of the tube by pushing a second rod similar to the first one which was introduced beforehand through the upper end.

One can then add a polycarbonate ring with a length of 18 mm, a wall thickness of 3 mm and an internal diameter of 13.3 mm. The middle of this ring is placed at the position of the disk, in the tube. The rods are then removed, the two compartments are filled, either completely or partially, with the respective liquids which will produce the chemiluminescence when brought in communication by manual tilting of the disk, and the ends are sealed closed.

According to an advantageous variant, two diaphragms or disks can be placed in contact with each other, with the contact faces being optionally greased to facilitate their tilting.

It is apparent that the device according to the invention can be used for other purposes than the production of chemiluminescent light. The chemical compounds contained in the compartments can be, in particularly, capable of producing, when mixed, heat, cold, or a glue for immediate use.

Numerous variations which have not been described can be made to the description of the chemiluminescent article according to the invention without going beyond the inventive principle as defined in the following claims.

We claim:

1. A chemiluminescent element comprising a tube made of a flexible, light-emitting and chemically stable material, which is closed at both of its ends and which comprises at least two compartments which are filled with liquids which produce chemiluminescent light when mixed, characterized by the fact that it contains, between said ends, at least one internal diaphragm or disk which separates the tube into said compartments, said diaphragm or disk 1) having approximately a circular shape with a cross-section which is approximately rectangular in profile and a peripheral sharp edge, 2) being positioned transversely with respect to the axis of the tube, 3) having its periphery in continuous contact with the interior of the tube wall, 4) being significantly more rigid than the material of which the tube is formed and 5) a thickness not greater than about one half the interior diameter of the tube, the elasticity, the external and internal diameters of the tube and the diameter of the diaphragm or disk being selected in such a manner that the diaphragm or disk can be tilted by simple pressure, manual measure or any equivalent means against the external walls of the tube, which pressure imparts a tilting torque on said diaphragm or disk and repositions said diaphragm or disk substantially parallel with respect to the axis of the tube thereby allowing the liquids in said compartments to mix.

2. An element according to claim 1, wherein the diameter of the diaphragm or disk is slightly larger than the internal diameter of the tube.

3. An element according to claim 1, wherein an external rigid ring whose internal diameter is slightly smaller than the external diameter of the tube at the position of the diaphragm or disk, is placed around the tube, concentrically with respect to the latter, and which can be loosened by sliding in the direction of the axis of the tube.

4. An element according to claim 3, wherein the diameter of the diaphragm or disk is equal to the internal diameter of the tube.

5. An element according to claim 1, wherein the tube and the diaphragm or disk are made of polyolefin material.

6. An element according to claim 3, wherein the ring is made of metal or a rigid plastic material

7. An element according to claim 1, wherein the tube wall comprises of at least two layers of light-transmitting material whose combination constitutes an effective barrier against the permeation of carbon dioxide towards the exterior and/or moisture toward the interior.

8. An element according to claim 7, wherein the tube is a coextruded tube, with the internal wall consisting of polyethylene.

9. An element according to claim 1, wherein the internal diameter of the tube is between about 8 and about 18 mm and the thickness of the diaphragm or disk is between about 1 and about 4 mm.

10. An element according to claim 1, wherein the diaphragm or disk is coated with a sealing grease over the entire edge prior to its positioning.

11. An element, comprising a tube made of a flexible, light-transmitting and chemically stable material, closed at both of its ends, and comprising at least two compartments which are filled with liquids which produce chemiluminescent light when mixed, characterized by the fact that the tube contains, in addition, between its ends, an internal diaphragm or disk which separates the tube into said compartments, the diaphragm or disk 1) having an approximately circular shape with a cross-section which is approximately rectangular in profile, 2) being placed transversely with respect to the axis of the tube, and 3) whose edge is in continuous contact with the interior of the wall of the tube, a rigid, external ring whose internal diameter is slightly less than the external diameter of the tube at the position of the diaphragm or disk, placed around the tube, concentrically to the latter, with the elasticity, the external diameters and the internal diameters of the tube, the internal diameter of the ring and, the diameter and thickness of the diaphragm or disk being selected in such a manner that the diaphragm or disk tilts when said ring is moved along the axis of the tube.

* * * * *